US006363850B1

(12) United States Patent
McEachern

(10) Patent No.: US 6,363,850 B1
(45) Date of Patent: Apr. 2, 2002

(54) MOUNTING PRINTING PLATE CYLINDER HAVING TAPERED BORE TO UNTAPERED ROTATABLE DRIVE SHAFT

(76) Inventor: David A. McEachern, 687 Lincoln Ave., St. Paul, MN (US) 55105

( * ) Notice: Subject to any disclaimer, the term of this patent is extended or adjusted under 35 U.S.C. 154(b) by 0 days.

(21) Appl. No.: 09/444,457

(22) Filed: Nov. 22, 1999

(51) Int. Cl.[7] ..... B41F 13/10
(52) U.S. Cl. ..... 101/375; 101/477; 497/27
(58) Field of Search ..... 101/375, 378, 101/479, 395, 401.1, 382.1, 383, 477; 492/27

(56) References Cited

U.S. PATENT DOCUMENTS 1,230,190 A * 6/1917 McIndoe et al.
2,587,606 A * 3/1952 Dungler ..... 101/248
3,693,544 A * 9/1972 Tryzna ..... 101/375
3,694,844 A * 10/1972 Welter ..... 15/182
3,739,722 A * 6/1973 Zottoli ..... 101/375
4,594,068 A * 6/1986 Bardutzky et al. ..... 432/60
4,864,926 A * 9/1989 Saueressig ..... 101/153
5,195,430 A * 3/1993 Rise ..... 100/168
5,819,648 A * 10/1998 Megyesi ..... 101/38.1
5,904,095 A * 5/1999 Nelson ..... 101/375
5,996,494 A * 12/1999 McEarchern ..... 101/375

FOREIGN PATENT DOCUMENTS

JP 356008264 A * 1/1981 ..... 101/170

* cited by examiner

*Primary Examiner*—Eugene Eickholt
(74) *Attorney, Agent, or Firm*—Jacobson and Johnson

(57) ABSTRACT

A printing plate or decorator cylinder has a tapered bore for engaging the tapered outer surface of a sleeve member which is mounted on an untapered rotatable drive shaft and the sleeve is adjustably coupled to the shaft to permit accurate registration of the printed indicia when a printing plate is changed.

4 Claims, 4 Drawing Sheets

MOUNTING PRINTING PLATE CYLINDER HAVING TAPERED BORE TO UNTAPERED ROTATABLE DRIVE SHAFT

FIELD OF THE INVENTION

This invention is directed toward adjustably mounting a printing plate cylinder, for example a magnetic cylinder to a rotatable drive shaft of a printing press or the like.

DESCRIPTION OF THE PRIOR ART

U.S. Pat. No. 5,819,648 by Megyesi point out some of the problems encountered in using a printing plate cylinder, such as a magnetic cylinder, in printing presses and decorator machines and the like. In practice the printing plate or decorator plate usually has to be changed often which in many cases requires that the printing plate cylinder with attached plate has to be removed from the drive shaft and a new plate installed, or a different cylinder with an attached printing plate installed on the drive shaft. Each time the printing plate is changed it may require some small amounts of adjustment both axially and circumferentially to bring the indicia on the new printing plate into proper registration with respect to other printed indicia. The Megyesi '648 patent describes some of the problems associated with removal and replacement of the printing plate cylinders on a decorator machine and the need to have adjustments available to bring the indicia on the printing plate into close registration with the other printed indicia. As is well-known in the commercial field and as mentioned in the '648 patent, some printing presses or decorator machines have straight or right angle cylindrical rotatable shafts and others have tapered shafts. The untapered shaft generally allows for easier adjustability but repeated replacement usually causes some wear to the bore of the printing plate cylinder and/or the shaft. The tapered shaft has the advantage of minimizing the amount of wear caused by repeated replacements but lacks adjustability. The '648 patent utilizes an inner member or sleeve which has a tapered or conical shaped axial bore to engage a tapered rotatable drive shaft. The outer surface of the sleeve is untapered to engage the untapered axial bore of an outer sleeve or printing plate cylinder. In this arrangement to bring the printing plate into registration the outer printing plate cylinder is adjusted with respect to the inner sleeve which remains mated to or engaged with the tapered shaft. To gain the advantage of a tapered shaft when the printing plate or decorator plate has to be changed the entire combination of the inner member or sleeve and the outer member or printing plate cylinder (as well as the attached printing plate) is removed from the shaft and replaced with a new similar combination with a new printing plate or a new printing plate is replaced on the printing plate cylinder and the same unit or assembly is then reinserted on the tapered drive shaft.

Another embodiment of an adjustable printing plate cylinder by the same applicants as the instant application is a printing plate cylinder with a linear bearing press-fitted into the bore for engaging an untapered rotatable printing press drive shaft. The linear bearing minimizes the wear which normally is encountered when mounting the cylinder on an untapered drive shaft and also allows for both axial and circumferential adjustment of the printing plate cylinder as needed.

SUMMARY OF THE INVENTION

A sleeve member has an untapered bore for engaging and surrounding an untapered rotatable drive shaft of a printing press or the like and fits snugly but adjustably on the untapered drive shaft. The outer surface of the sleeve is tapered. A printing plate cylinder has a correspondingly tapered axial bore for engaging the outer surface of the sleeve member. When replacing a printing plate, only the printing plate cylinder, with attached printing plate, is removed from the sleeve member which remains engaged with the drive shaft. The tapered coupling between the sleeve member and the printing plate cylinder produces some benefits attributable to a tapered shaft yet at the same time, the untapered bore of the sleeve member engaging the untapered shaft retains the benefit of the adjustability feature associated with an untapered drive shaft. When a printing plate is changed only the printing plate cylinder (with attached printing plate) is removed. Because of the tapered bore of the printing plate cylinder it can then be replaced onto the outer tapered surface of the sleeve member so that the printing place is close to the ultimate registration. The sleeve member can then be adjusted both axially and circumferentially with respect to the drive shaft to bring the printing plate into precise registration.

In the aforementioned Megyesi device, because of the weight of the assembly which has to be removed from and replaced on the shaft when replacing a printing plate, the outer sleeve of the Megyesi device preferably is made out of a lighter weight metal such as aluminum. By comparison, since the instant invention requires only that the outer printing plate cylinder be removed and replaced for changing the printing plate it can be made out of a heavier metal such as steel. The parts made of steel are more uniform and are more stable (hold their dimensions better) and can be machined more accurately and precisely. This results in a significant savings in manufacturing costs and registration can be more accurate and precise.

In the '648 patent, when changing printing plates both the inner and outer members are removed from the shaft and the assembly is usually cleaned (to remove ink and other materials). The cleaning process may result in dissolving surface lubrication between the members which is used to keep the members from binding up. Therefore, the usual practice is to separate the members after they are removed from the shaft and then relubricate after cleaning. In the instant invention only the printing plate cylinder is removed and cleaned before replacing on the sleeve. The lubrication is between the shaft and the bore of the sleeve which remains untouched and unchanged during replacement of a printing plate. Therefore, relubrication is not required.

DESCRIPTION OF THE PREFERRED EMBODIMENTS

Figure 1:
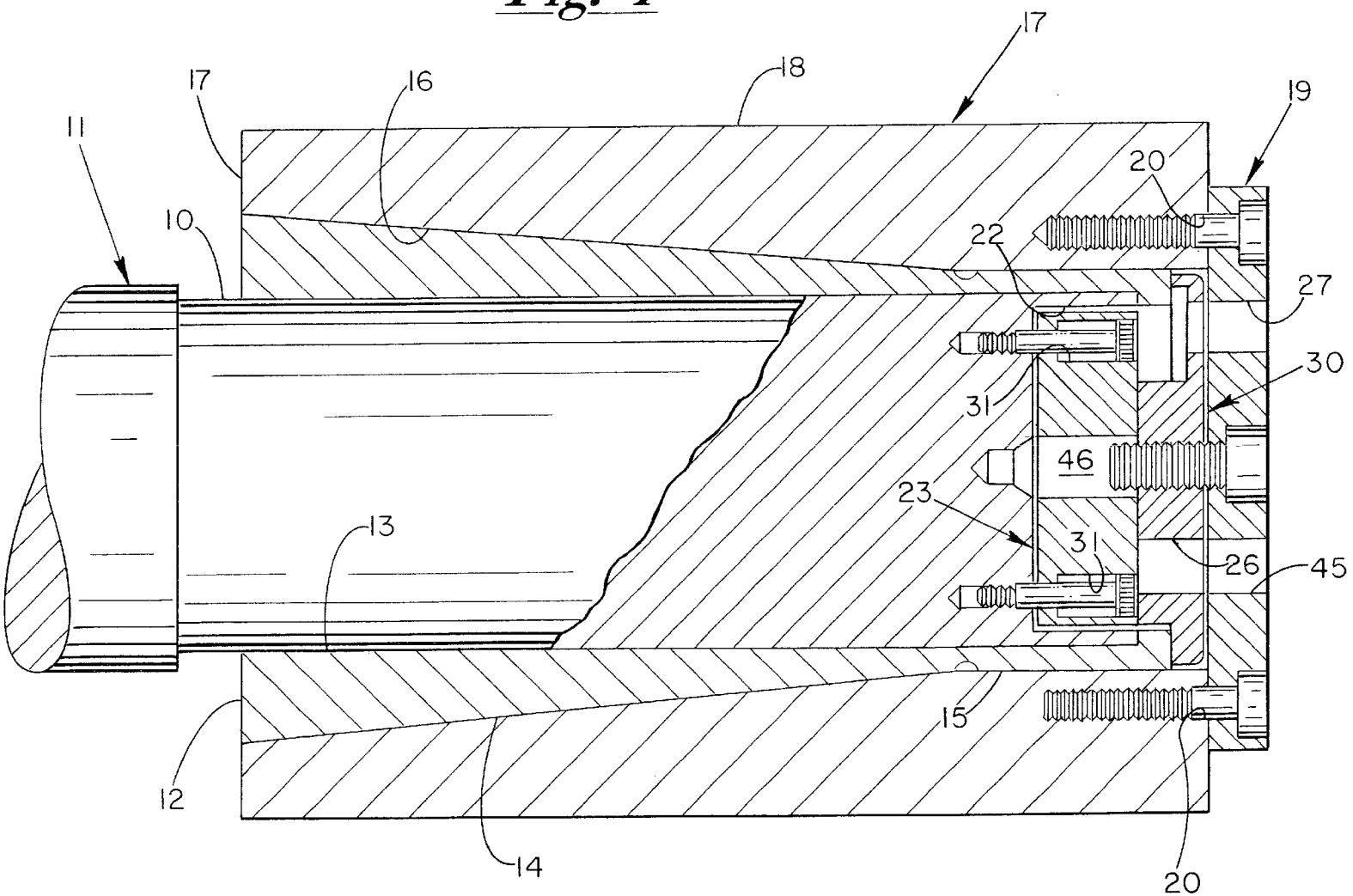
FIG. 1 is a partial section side view of a preferred embodiment of the invention.

Referring to FIG. 1, a cylindrical untapered printing press drive shaft 10 is attached in conventional fashion at one end to a conventional driving source identified generally by reference numeral 11 for rotatably driving the shaft in a conventional and well-known fashion. A sleeve 12 has a central or axial untapered cylindrical bore 13 for engaging shaft 10 with its outer surface 14 tapered generally inward from the attached end of shaft 10 to the open or distal end of the shaft for a significant length and continues with a cylindrical or untapered length identified by reference numeral 15. The outer end of sleeve 12 has an inward extending flange. The bore 13 of sleeve 12 fits over and surrounds shaft 10 snugly yet it can be adjusted both circumferentially and axially a small amount as necessary with respect to the shaft, as will be described later. Fitting over the outer tapered surface 14 of sleeve 12 is the tapered inner bore 16 of a printing plate cylinder 17. Conventionally a printing plate, not shown, is mounted on the untapered outer surface 18 of printing plate cylinder 17. A mounting ring 19 is attached to the outer end of printing plate cylinder 17 by threaded bolts engaged in the threaded openings 20, see FIG. 5. The cylinder 17 may be a magnetic cylinder or a type which holds the printing plate in place by mechanical means.

The outer or unattached end of shaft 10 is counter sunk to form a depression or recess identified by reference numeral 22. Resting in recess 22 is a push/pull block 23. Preferably recess 22 is cylindrical in shape and push/pull block 23 is in the form of a disk which rests in recess 22. Disc or block 23 is free to move axially within the recess, within limits, but not circularly or circumferentially. Certain restraints are places on the movement of block or disk 23 as part of the necessary adjustment to bring the printing plate cylinder into correct registration each time the printing plate is changed.

Figure 5:
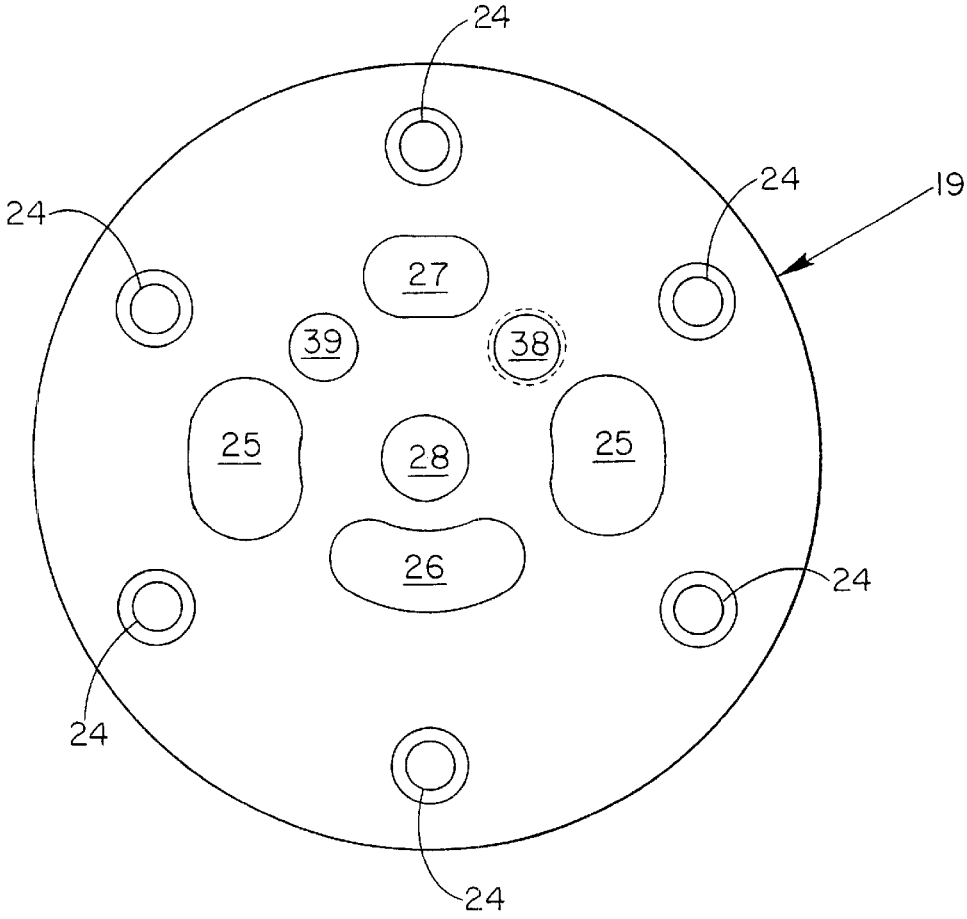
FIG. 5 is an end view of the mounting ring for attaching the printing plate cylinder to the sleeve.
Figure 6:
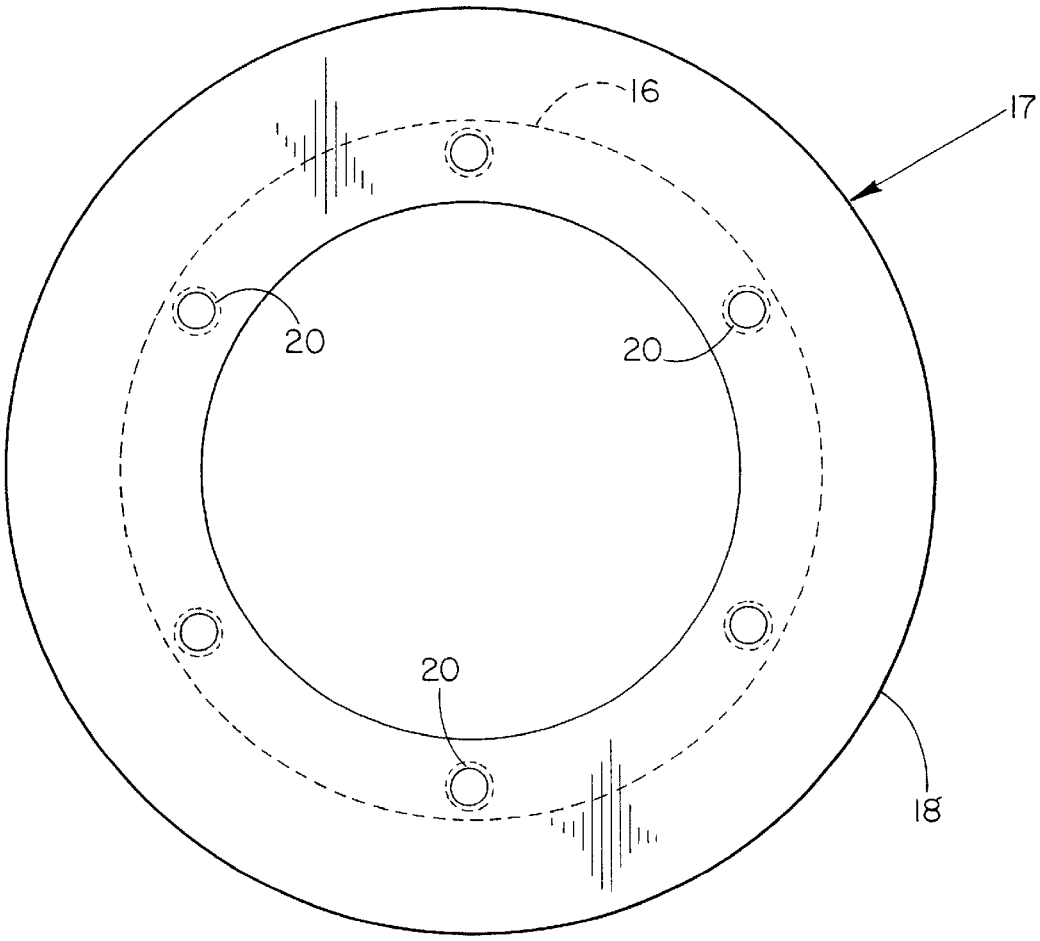
FIG. 6 is an end view of the printing plate cylinder.

FIG. 5 illustrates greater detail of the cylinder mounting ring 19. Openings 24 are for threaded bolts which engage threaded openings 20 for attaching the mounting ring to the end of the printing plate cylinder 17. Slotted openings 25 are access openings for allowing access to bolts which may have to be loosened and then retightened during circumferential adjustment of the printing plate. Slotted opening 26 allows access to adjustment screws which are used for axial adjustment of the printing plate. Slotted opening 27 allows access to an adjustable cam or gear which is used in the circumferential adjustment. The adjustments are done in a conventional and well-known fashion. The central or axial opening 28 is for a threaded bolt for attaching the mounting ring 19, with the attached printing plate cylinder 17, to end cap 30 which is attached to sleeve 12. Threaded opening 38 is merely used for assisting in removing or disengaging the mounting ring with attached printing plate cylinder from sleeve 12. A screw, not shown, is threaded into opening 38 to make contact with or butt against end cap 30. As the screw advances it helps dislodge the printing plate cylinder from the sleeve. Opening 39 receives a dowel pin, not shown, which acts as a keyway for aligning mounting ring 19 to end cap 30 when the printing plate cylinder is being placed on sleeve 12.

As mentioned earlier, the present invention results in benefits usually attributed to a tapered shaft while at the same time achieving benefits of the circumferential and axial adjustments which are normally experienced by using an untapered or a cylindrical shaft. This is achieved by using a sleeve 12 having an untapered bore for engaging an untapered rotatable drive shaft 10 so that the sleeve 12 can be moved slightly as necessary with respect to the shaft to obtain the circumferential and axial adjustments as needed for accurate registration. For removable attachment of printing plate cylinder 17 the outer surface of sleeve 12 is tapered to engage the tapered bore 16 of cylinder 17. Mounting ring 19 attaches cylinder 17 to end cap 30 which in turn is attached to sleeve 12 whereby moving sleeve 12 circumferentially and/or axially with respect to shaft 10 results in circumferential and/or axial adjustment of cylinder 17. As described earlier, to change a printing plate, cylinder 17 is removed from sleeve 12 by unthreading the bolt (not shown) in opening 28 of mounting ring 19 and sliding cylinder 17, with attached mounting ring 19, off sleeve 12 using a dislodging screw in opening 38 if necessary. A new printing plate is then placed on the printing plate cylinder 17 which is then replaced on sleeve 12 and bolted on. Alternatively, a new or different printing plate cylinder 17 with attached printing plate is slipped over sleeve 12. In any event, only the printing plate cylinder with its attached printing plate and mounting ring is removed and replaced as compared to the aforementioned Megyesi device in which the entire assembly including the inner sleeve and the outer sleeve and printing plate and adjustment mechanism is removed from the shaft for replacement of the printing plate. Because the components are made of metal, they are quite heavy so to lighten the load the Megyesi components are made out of lighter weight metal such as aluminum or something similar. This can result, and has resulted, in some manufacturing problems, e.g., the aluminum components may not hold tolerances. Since the instant invention requires fewer component parts be removed and replaced when changing printing plates, cylinder 17 and sleeve 12 can be made out of a heavier and stronger metal, such as steel or similar, which hold tolerances more closely thereby achieving a significant manufacturing benefit.

Figure 3:
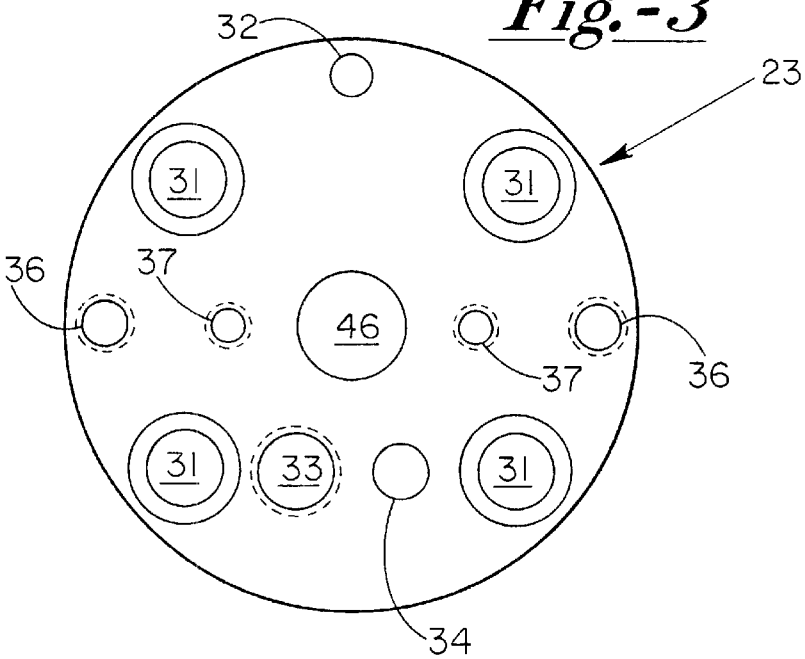
FIG. 3 is an end view of a push/pull block utilized for adjustment of the printing plate cylinder.
Figure 4:
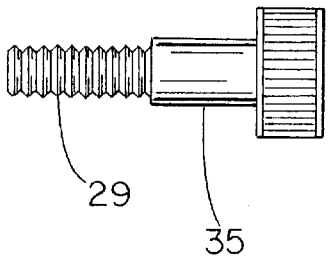
FIG. 4 illustrates a shouldered bolt.

One of the components or elements utilized for adjustment is the push/pull block or disk 23 which rests within the recess 22 at the end of shaft 10. Referring to FIG. 3, push/pull block 23 is attached to the end of shaft 10 by four shouldered bolts inserted through counter-sunk openings 31. As illustrated in FIG. 4, the bolts have a partially threaded length identified by reference 29 to engage corresponding threaded openings in the end of shaft 10, not shown, and have an unthreaded shoulder 35 which permits push/pull block 23 to move longitudinally or in an axial direction while still attached to shaft 10. In this fashion, then, push/pull block 23 is attached to shaft 10 yet has some degree of freedom of movement in an axial direction with respect to shaft 10 but cannot rotate or move circularly or in a circumferential direction with respect to shaft 10. Opening 32 is to accommodate and accept a pin for attaching a cam or gear to make a circumferential adjustment of sleeve 12 with attached cylinder 17 which is done in a conventional fashion. Openings 33 and 34 are utilized for axial adjustment which is also done in a conventional fashion. A bolt or threaded screw, not shown, is threaded through opening 33 and the end of the bolt makes contact with or butts against the end of shaft 10 at the bottom of recess 22. The other axial adjustment opening 34 contains a screw, not shown, with clearance between opening 34 and the screw but with the screw threaded into a threaded opening, not shown, in the end of shaft 10. When the bolt in opening 33 is threaded inwardly or advanced it moves push/pull block 23 axially outward or toward the free end of shaft 10 and when the screw in opening 34 is advanced it serves to pull push/pull block 23 inwardly or in the opposite direction toward the attached end of the shaft, i.e., toward the bottom of recess 22. Push/pull block 23 is linked to sleeve 12 via end cap 30 and printing plate cylinder 17 with attached printing plate is coupled to sleeve 12 via mounting ring 19 so that the printing plate can be adjusted axially as needed to bring it into proper axial registration by axially adjusting push/pull block 23. The two threaded openings 36 are to receive threaded bolts, not shown, which attach push/pull block 23 to the end cap 30 and thereby transfer the adjustments as described to the printing plate cylinder. Threaded openings 37 are to receive threaded bolts, not shown, for loosely attaching push/pull block 23 to end cap 30 for precaution to prevent the remote possibility of the two becoming disengaged during circumferential adjustment. Opening 46 in push/pull block 23 is merely to provide clearance for the bolt which attaches mounting ring 19 to end cap 30.

Figure 2:
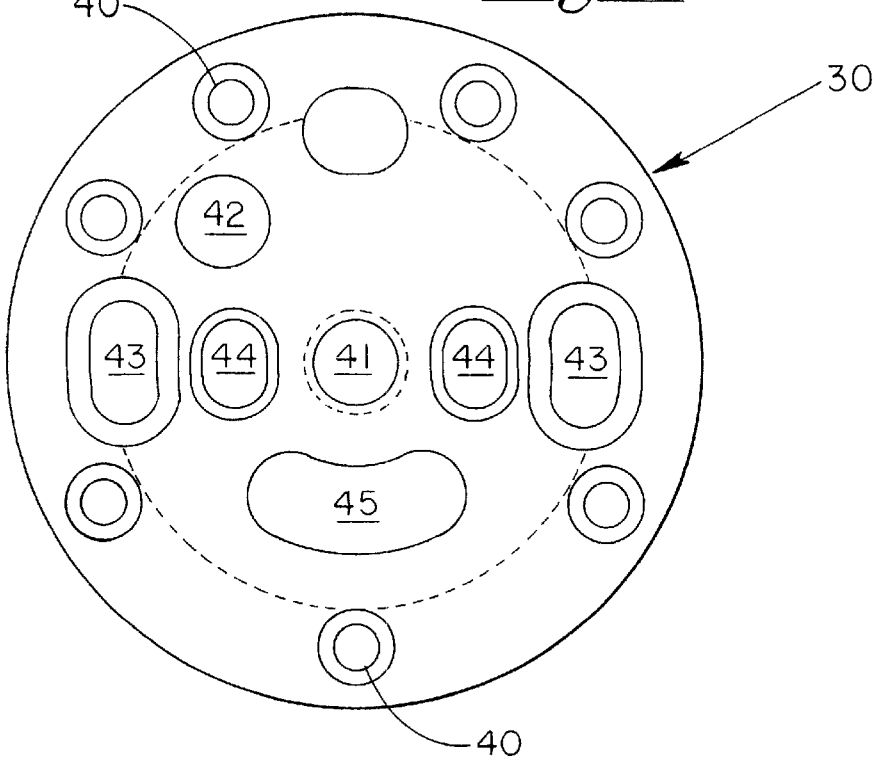
FIG. 2 is an end view of an end cap which is attached to the sleeve and used for adjustment of the printing plate cylinder.

Referring now to FIG. 2, end cap 30 is used for attaching push/pull block 23 to sleeve 12. The seven outer peripheral shouldered openings 40 are for screws or bolts for attaching end cap 30 to the end of sleeve 12. The central threaded opening 41 is to receive a bolt which passes through opening 28 on mounting ring 19 for attaching the mounting ring, along with the printing plate cylinder 17, to end cap 30 thereby connecting printing plate cylinder 17 to sleeve 12. When the printing plate is to be changed the bolt is unthreaded from opening 41 and the mounting ring 19 and printing plate cylinder 17 are slipped off sleeve 12. An indexing hole 42 receives the dowel pin that fits into opening 39 in mounting ring 19 for alignment purposes when the printing plate cylinder is being placed on sleeve 12. Slotted openings 43 are for the bolts which thread into openings 36 of push/pull block 23 and slotted openings 44 are for the bolts which thread into openings 37 on push/pull block 23. Slotted opening 45 provides access to the axial adjustment screws or bolts which are in openings 33 and 34 in push/pull block 23.

I claim:

1. Apparatus for mounting a plate cylinder to a printing press:

an elongated untapered cylindrical shaft attached at one end to a source for rotationally driving said shaft;

a sleeve having an axial untapered bore for engaging the outer surface of said shaft, said sleeve having a tapered outer surface;

a plate cylinder having an untapered cylindrical surface for holding a printing plate and a tapered bore for engaging the outer surface of said sleeve;

a recess at the distal end of the shaft;

a push/pull member resting in said recess;

means coupling said push/pull member to the shaft for axial adjustment of said push/pull member with respect to the shaft; and an end cap coupling said push/pull member to said sleeve for transferring any axial adjustment from said push/pull member to said sleeve.

2. The apparatus as described in claim 1 further including:

means for circumferentially adjusting said sleeve with respect to the shaft.

3. The apparatus as described in claim 2 further including a mounting plate attached to an end of said printing plate cylinder; and means for attaching said mounting plate to said end cap for ensuring that the axial and circumferential adjustments of said sleeve are transferred to said printing plate cylinder.

4. The apparatus as described in claim 3 wherein said mounting plate has openings for access to said axial and circumferential adjustment means.

* * * * *